United States Patent [19]

Felter

[11] 4,177,618

[45] Dec. 11, 1979

[54] METHOD AND APPARATUS FOR INSTALLING INSULATION

[76] Inventor: John V. Felter, P.O. Box 7464, Houston, Tex. 77008

[21] Appl. No.: 875,410

[22] Filed: Feb. 6, 1978

[51] Int. Cl.[2] ..... E04B 1/74

[52] U.S. Cl. ..... 52/743; 52/105; 52/404

[58] Field of Search ..... 52/743, 404, 407, 105

[56] References Cited

U.S. PATENT DOCUMENTS

| | | | |
|---|---|---|---|
| 2,020,908 | 11/1935 | Scammell | 52/105 |
| 2,788,552 | 4/1957 | Miles | 52/743 |
| 2,989,790 | 6/1961 | Brown | 52/743 |

*Primary Examiner*—J. Karl Bell

*Attorney, Agent, or Firm*—Carl B. Fox, Jr.

[57] ABSTRACT

Methods and apparatus for installing insulation, wherein insulation is delivered into vertical wall spaces formed between a permanent wall at one side and a plastic membrane at the other side, the permanent wall and the membrane being supported by vertical members such as studs. The membrane forms a vapor barrier over the wall area, and is covered by wallboard such as sheetrock or paneling, or the like. To prevent sag of the membrane during installation of the insulation, a shield plate is held against the outer side of the membrane during the time that the insulation is being delivered into the space between the permanent wall and the membrane.

10 Claims, 15 Drawing Figures

Fig. 15
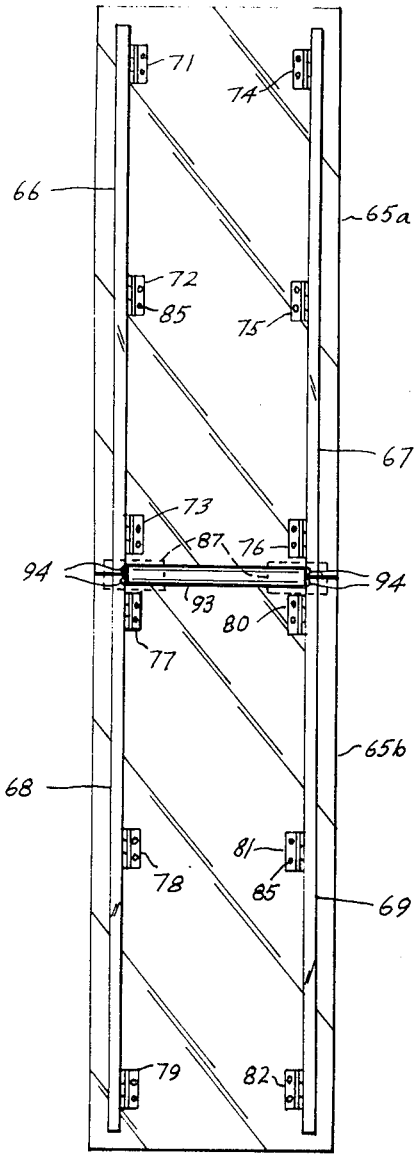
Fig. 12
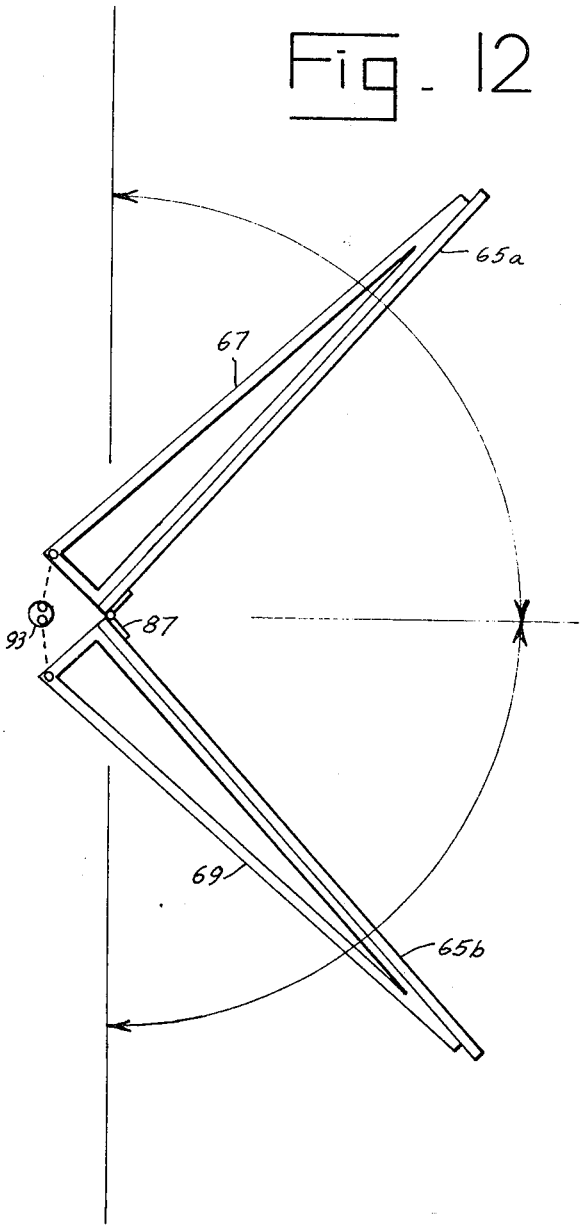
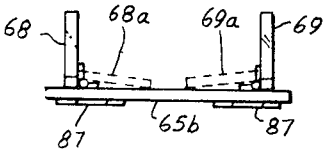
Fig. 13
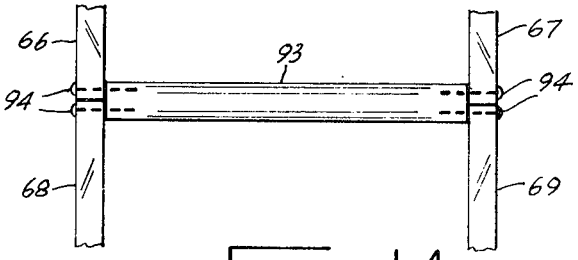
Fig. 14

METHOD AND APPARATUS FOR INSTALLING INSULATION

BACKGROUND OF THE INVENTION

At the present time, there is a scarcity of insulation widely used in walls of homes and other buildings, of the type wherein fibrous material, such as fiberglass or asbestos, is contained within a paper and/or aluminum covering which has projecting strips along opposite edges for nailing or stapleing to the studs or other frame members of the vertical walls of a building. Because of the current energy shortage, it is important that homes and other buildings be insulated properly during construction in order that as much heat and cooling can be conserved as is reasonably possible. Also, from the standpoint of economy in use of the building, the provision of adequate insulation is important. Loose insulation can be blown into walls which have been completed at both their outer and inner sides, but this manner of installation of insulation leaves something to be desired, in that cavities in the insulation can result, and in that no vapor barrier is provided by the insulation in addition to those normally provided, and in that settling of this type of insulation can be severe over a period of time so that the insulation becomes less effective. The present invention provides methods and apparatus so that adequate insulation can be efficiently and economically provided in walls despite the shortage or unavailability of the covered or bagged types of insulation heretofore employed.

SUMMARY OF THE INVENTION

The invention provides method and apparatus for installing insulation, primarily in vertical walls of buildings, wherein insulation is blown or otherwise delivered into the walls to between a permanent, usually outer, wall of the building, and a membrane, usually at the inner side of the wall. After installation of the insulation, the inner side of the wall may be completed in any desired manner to cover the membrane, so that the insulation is disposed permanently in the wall. The membrane is affixed to the studs or other vertical structural members of the wall to provide a space for receiving loose insulation material between the membrane and the outer or other side of the wall which is already in place. The loose insulation is blown or otherwise delivered into the space at the top of the membrane, which may terminate short of the tops of the studs or may be provided with an opening through which the insulation may be delivered.

During delivery of the loose insulation to behind the membrane, the membrane may have a tendency to sag away from the wall. Therefore, it is preferred that the membrane be temporarily supported during delivery of the loose insulation to behind the membrane. This is accomplished, according to the invention, through use of a shield plate to support the membrane while the insulation is being delivered into place. The shield plate covers the wall area into which the insulation is being delivered, and supports the membrane so that no outward sag of the membrane can occur. Once the insulation is in place, the tendency of the membrane to sag is greatly decreased. The tendency of the membrane to sag is primarily caused by the pressure of air used to blow the insulation to behind the membrane, or the falling of the insulation, and once these forces have been discontinued, the membrane will remain flatly in place with the insulation behind it.

A valuable advantage of the invention is that inspection of the insulation can readily be made during and after installation of the installation. The membrane is preferably in the form of a relatively thin film or sheet of transparent plastic, through which the insulation can be observed. Any cavitation of the insulation can be observed and corrected prior to covering the membrane to complete the wall. Additionally, a certain amount of compacting of the insulation can be done during and after delivery of the insulation to behind the membrane, by tapping or poking against the membrane, so that future settling of the loose insulation within the wall can at least to some extent be decreased. The shield plate can also be bumped against the membrane and studs or other wall supports during delivery of the insulation to cause compacting of the insulation without permitting undue outward sagging of the membrane.

A principal object of the invention is to provide methods and apparatus for installing insulation. Another object of the invention is to provide such methods and apparatus according to which insulation in loose form is placed in a space between a wall and a membrane. A further object of the invention is to provide such methods and apparatus which are economical and efficient and dependable. A still further object of the invention is to provide such methods and apparatus in connection with which a shield plate is employed to prevent sag of the membrane. Yet another object of the invention is to provide such methods and apparatus wherein the membrane is transparent to afford visual inspection of the disposition of the insulation as it is installed, and afterward. A further object of the invention is to provide such methods and apparatus including the compacting of the loose insulation whereby later settling of the insulation is decreased. Another object of the invention is to provide a shield plate which may be employed to prevent sag of a membrane behind which insulation is being installed.

Other objects and advantages of the invention will appear from the following detailed descriptions of preferred embodiments of the invention, reference being made to the accompanying drawings.

BRIEF DESCRIPTIONS OF THE DRAWINGS

FIG. 12 is a side elevation of a further modified embodiment of shield plate.

FIG. 13 is an end view of the embodiment of FIG. 12.

FIG. 14 is an enlarged partial view of the embodiment of FIG. 12.

FIG. 15 is a front elevation of the embodiment of FIG. 12.

DESCRIPTIONS OF THE PREFERRED EMBODIMENTS

Figure 1:
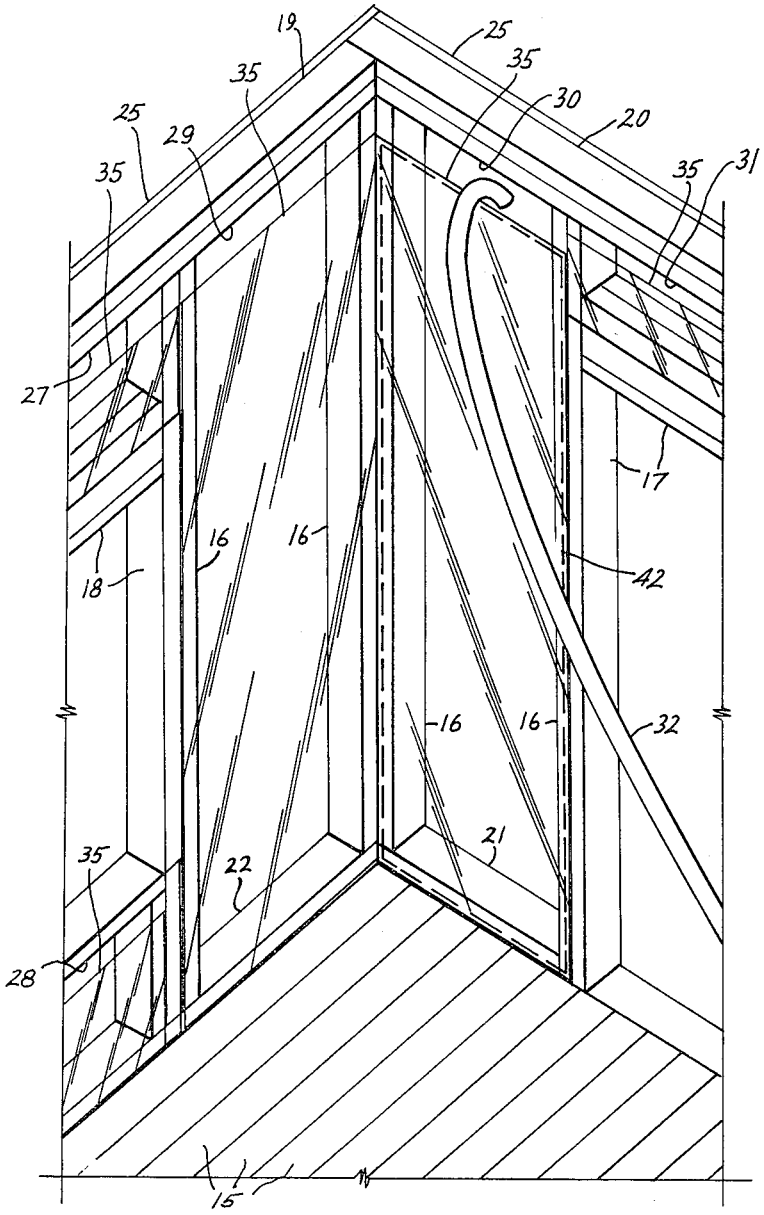
FIG. 1 is a perspective view illustrating a step of the methods according to the invention, and indicating use of the apparatus afforded thereby, in preferred manners according to the invention.

Referring now to the drawings in detail, and first to FIG. 1 of the drawings, a partial building structure is shown, including floor boards 15, studs 16, door frame 17, window frame 18, composite beams 19, 20, and wall base members 21, 22. Various other framing members, not specifically described, are shown, the purpose of which will be apparent to those skilled in the art. Other parts of the building structure are not shown, for example, no roof elements are shown.

An outside wall structure is indicated at 25, which sheathes the building except at the locations of the door and window. Between the studs 16, spaces are formed which are indicated by reference numerals 27–31. These are the spaces in which insulation will normally be installed, to prevent heat passage either outwardly or inwardly through the walls, and to minimize sound transmission through the walls.

According to the invention, loose, unconsolidated insulation in particulate form is installed in the walls in a unique manner. The insulation may consist of any suitable material, such as asbestos, rock wool, fiber glass, cellulose, or other material in subdivided form useful for insulation purposes. Such insulation is usually installed through use of a blower apparatus, the insulation particles being picked up in an air stream and flowed to location through a tube or hose such as the hose 32 shown in FIG. 1.

The spaces 27–31 are covered at their inner sides by sheets or membranes 35 formed by plastic films. The plastic film material forming membranes 35 are relatively thin, yet are capable of containing the insulation placed behind them to hold it in place. Membranes 35 are preferably transparent, in order that insulation placed behind them can be observed or inspected to determine if any cavities or voids in the insulation exist, and to assist in the filling of such voids. In addition, the transparency of the membranes enables the workmen installing the insulation to determine the progress of insulation installation at all times and to control the blower equipment.

In FIG. 1, the membranes 35 are shown to terminate upwardly somewhat below the structural cross members across the upper ends of the spaces 27–31. The spaces above the membranespermit the end of hose 32 to be inserted for the purpose of blowing in the insulation material, as is shown at space 30 in FIG. 1. As will now be clear, insulation will be blown into space 30 through tube 32 which extends from suitable blower apparatus capable of picking up the insulation material in an air stream and conveying it through tube 32 into the space into which the insulation material is to be placed.

Figure 2:
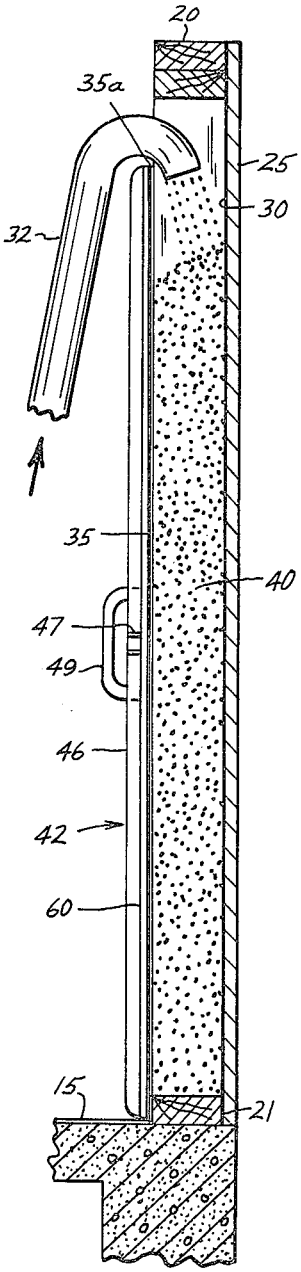
FIG. 2 is a vertical cross section showing the methods and apparatus in preferred form according to the invention.
Figure 3:
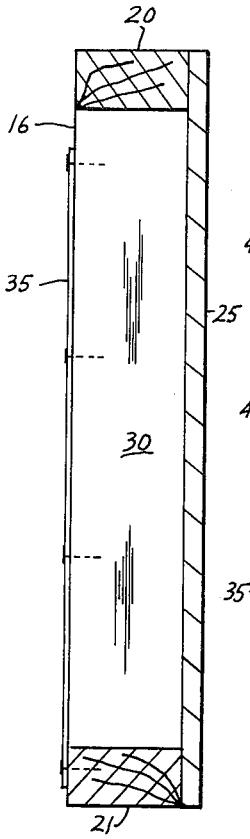
FIGS. 3–6 are schematic drawings illustrating the steps of one method according to the invention.

Referring now to FIG. 2 of the drawings, the above described operation is shown in more detail. The hose 32 is shown bent over the upper edge 35*a* of the membrane 35. Membrane 35 is stretched to be flat over the interior side of space 30, being affixed to the studs and other structural elements at the sides of space 30 by nails or staples or the like (not shown). The insulation material 40 in subdivided form is blown into space 30, between membrane 35 and outer wall 25, through tube or hose 32, this being continued until space 30 is filled. Alternatively, the insulation may be placed into space 30 by hand, or in other suitable manner.

Since the membrane 35 is relatively weak, and may be somewhat elastomeric, it is desirable that it be supported while the insulation is being delivered into space 30, so that the membrane will not be displaced away from its disposition in a flat plane. Such sagging of the membrane will be caused mainly because of the pressure of air that is developed in space 30 behind the membrane as a result of the pressured air used to deliver the insulation material. The sagging may become quite pronounced unless steps are taken to prevent it. Even when the insulation is placed into space 30 by hand, the repeated impacts of insulation within space 30 may cause unwanted sagging of the membrane.

According to the invention, the sagging of the membrane is preferably eliminated through use of a shield plate 42. Shield plate 42 is shown in dashed line outline form in FIG. 1, in order that the elements behind it will not be obscured. The shield plate is placed to cover the membrane 35 over the area of the wall space to be filled with insulation, as indicated by the position of shield plate 42 in FIGS. 1 and 2. The plate should overlap the studs at the sides of the space, and should overlap the element forming the bottom of the space, in order that no sagging of the membrane caused by air pressure or impact will occur. The plate is shown to have strengthening rib elements 46, 47, to be further described, and which may be of any suitable form, and has a handle 49 by means of which the shield plate may be transported and held in place during filling of the wall with insulation. Once the insulation is in place behind the membrane and the shield, the shield may be removed. Since the insulation is at rest and in a more or less stabilized condition, and since the air pressure will have been dissipated from space 30, the membrane will be fully capable of supporting the insulation in space 30 after the shield has been removed.

During filling of the wall with insulation, it may be observed through the membrane 35 and through the shield 42, which is also formed of a transparent material. The shield may, for example, be formed of Plexiglass in sheet form. Plexiglass, and other suitable materials of like characteristics, is rigid and capable of providing a firm backup for the membrane, so that no sagging or other displacement of the membrane will occur.

The shield may be held in place other than by hand, to cover the membrane over space 30, for example, by a prop engaged between the floor and the lower side of handle 49.

Referring now to FIGS. 3–6 of the drawings, FIG. 1 illustrates the initial step of the invention methods, that is, the disposition of membrane 35 between the studs at the opposite sides of space 30. The membrane may be affixed to the studs and other structural elements by nails 50 or in other suitable manner, such as by stapling, taping, or glueing, or the like.

Figure 4:
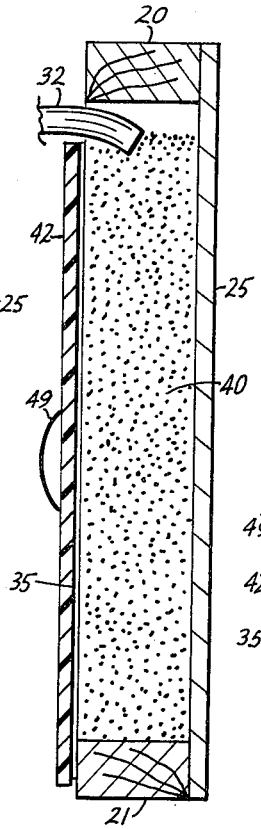

Next, as shown in FIG. 4, the shield plate 42 is placed over the membrane 35 and held or supported there, the hose 32 is inserted over the top of membrane 35, and the insulation material 40 is blown into space 30. Shield plate 42 prevents sagging or other displacement of the membrane during this step.

Figure 5:
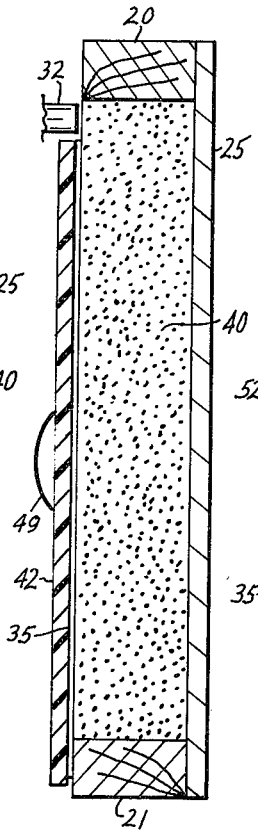
Figure 6:
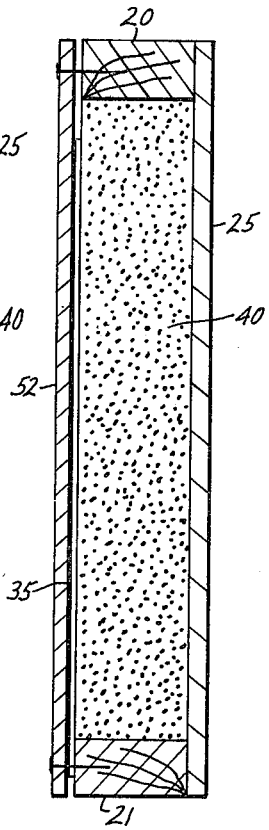

Referring to FIG. 5, the hose 32 is withdrawn somewhat and positioned to fill the space 30 above the upper end of membrane 35, as shown. This upper space may, if desired, be filled with insulation by hand.

Finally, the shield plate 42 is removed, and a wall element 52, which may be sheetrock, wallboard, paneling, or other suitable wall panel element, is nailed by nails 53 driven therethrough and into the studs and other framing members, or otherwise suitably secured in place. The membrane 35 does not sag upon removal of the shield plate, since the insulation material once being disposed in space 30 becomes somewhat stabilized and does not tend to push the membrane from its planar position. After the wall panel has been installed, the membrane is again fully supported. The membrane serves as an additional vapor barrier across space 30, supplementing other vapor barriers which may be included with the outside wall 25 or with the inside wall 52.

Figure 7:
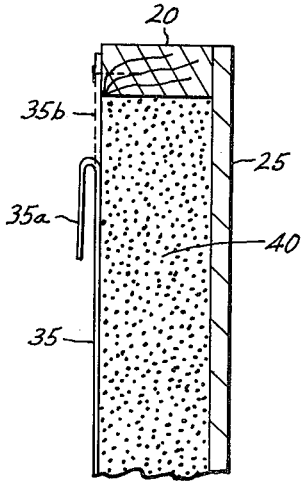
FIG. 7 is a schematic drawing illustrating a modification of the method shown in FIGS. 3–6.

Proceeding now to FIG. 7 of the drawings, a modification is shown which improves the vapor barrier characteristics of the membrane 35. In this modification, which is the preferred structure for the membrane, the membrane is folded down at its upper edge at 35*a* to leave a space thereabove through which the hose 32 may be inserted to fill the wall with insulation material 40. After the space 30 has been completely filled, the membrane flap 35*a* is moved to position 35*b* and secured in place so that the membrane covers the entire area of space 30. Although not shown in FIGS. 1–6, the FIG. 7 structure for the membrane is preferred, since it provides a complete vapor barrier over the entire wall area.

It will be understood that several wall spaces such as space 30 may be filled with insulation and covered by a single piece of wall board 52 which extends over the several wall spaces.

As mentioned earlier, cavities in the insulation may be filled by manipulations carried out through the membrane or through the gap above the membrane, in order that the wall spaces will be filled with insulation in uninterrupted manner before the wall board is installed. Observations of such cavitations may be made through the membrane, or through both the membrane and the shield plate, both of which are preferably transparent for this purpose.

Figure 8:
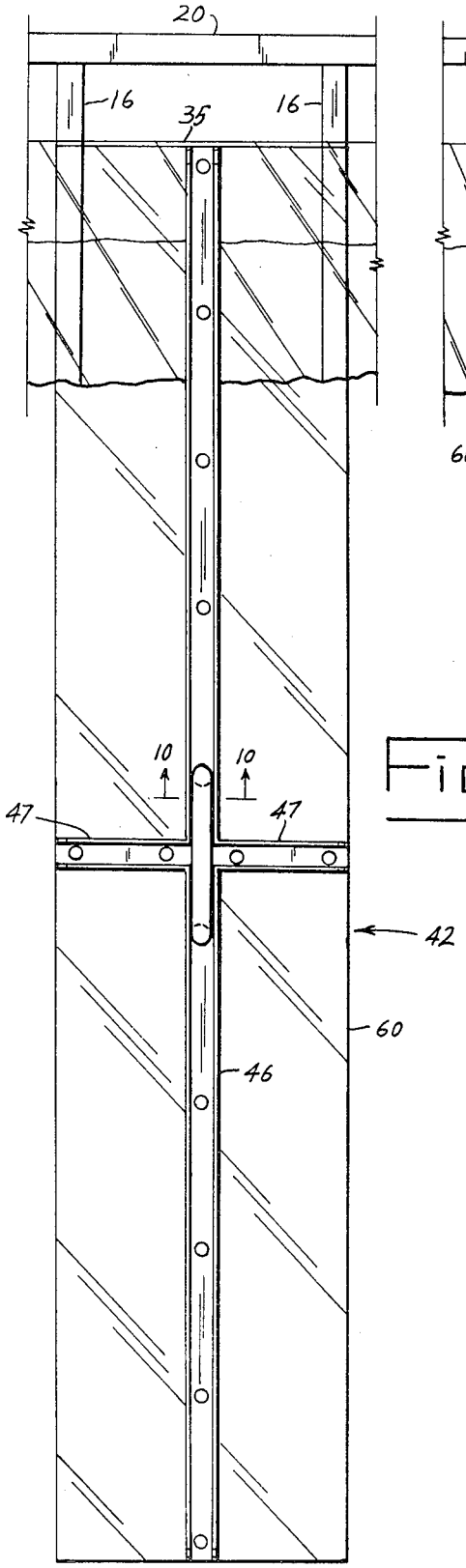
FIG. 8 is an elevation showing another modification of the methods and apparatus according to the invention.
Figure 10:
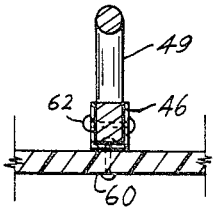
FIG. 10 is a horizontal cross section taken at line 10—10 of FIG. 8.

The shield plate structure is more clearly shown in FIG. 8. The shield plate 42 is formed by an integral sheet of plastic material 60, preferably transparent. The strengthening elements 46, 47 are each of U-shaped section, as shown, riveted or bolted to sheet 60 by rivets or bolts 61. The handle is bolted or pinned in place by bolts or crosspins 62 disposed therethrough and through the opposite walls of strengthening element 46, as is also shown in FIG. 10.

Figure 9:
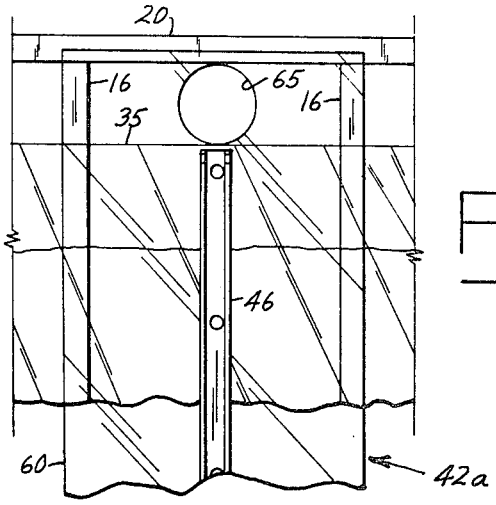
FIG. 9 is a partial elevation showing a further modification, according to the invention.
Figure 11:
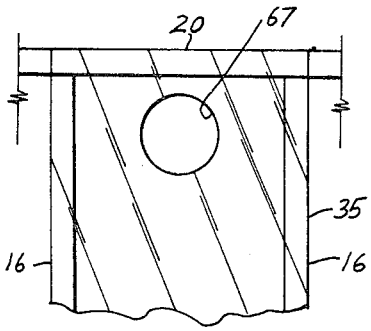
FIG. 11 is a partial elevation showing yet another modification according to the invention.

A modification of the shield plate is shown in FIG. 9. In this form, the shield plate 42*a* extends upwardly beyond the upper edge or the fold-down edge of the membrane, to cover the entire opening of space 30, and has a hole 65 therethrough through which the hose 32 may be disposed for delivery of the insulating material. Another modification is shown in FIG. 11 of the drawings, in which the membrane 35 extends over the entire front of space 30 at the top of the space, and the membrane has an opening 67 therethrough through which the tube 32 may be inserted for delivery of the insulating material. The FIG. 9 and FIG. 11 modifications may be used together, of course, and it will also be clear that any of the other modifications of apparatus may be used together in any combinations.

FIGS. 12–15 show a further modified shield plate according to the invention, which may be folded to half its length when it is not in use. The transparent plastic plate which is adapted to be disposed to support the plastic film 35 is formed by two half plates 65*a*, 65*b*. Triangular braces 66–69 are affixed, disposed as shown, to half plates 65*a*, 65*b* by hinges 71–82, secured by bolts or rivets 85. Braces 66–69 may be pivoted inward to positions against plates 65*a*, 65*b*, as shown for braces 68, 69 only, at positions 68*a*, 69*a* in FIG. 13. The half plates 65*a*, 65*b* may then be pivoted together as shown in FIG. 12. The half plates are connected end to end by hinges 87, and may be brought together at line 88 from their in-line positions at lines 89, 90, and vise versa, the 90° relative movement of each half plate being indicated by the arrow-ended arc lines 91, 92. For storage or transport, the braces 66–69 are pivoted to be against the backs of the half plates, as at 68*a*, 69*a* in FIG. 13, and the half plates are brought together as at line 88 of FIG. 12. When the apparatus is to be used, the half plates are pivoted to be in-line, as at lines 89, 90 of FIG. 12, and the braces 66–69 are pivoted to their perpendicular positions. The braces are then locked together by placement of bar 93 between the pairs of braces, as shown in FIGS. 14 and 15, bar 93 being fixed in place by the screws 94 so that the entire assembly is locked rigidly together for use. The bar 93 and the braces 66–69 serve as handles for holding the apparatus in place during use. Since the shield plate will be seven to eight feet in length, handling and transport of the shield plate is simplified by folding it to the half-length condition.

The invention provides methods and apparatus for installation of insulating material in walls which are efficient, simple, and dependable, and which will result in economies of construction. Moreover, the insulation installed according to the invention will have high insulating capacity and will endure for the life of the structure.

While preferred embodiments of the invention, both methods and apparatus, have been described and shown in the drawings, many modifications thereof will be apparent to those skilled in the art without departing from the spirit of the invention, and it is intended to protect by Letters Patent all forms of the invention falling within the scope of the following claims.

I claim:

1. Method for installing loose insulation in a space enclosed vertically therearound except at one side and enclosed at its bottom, comprising covering said one side of said space with a sheet of plastic film to support insulation in said space and to form a vapor barrier, said plastic film being temporarily supported by a movable flat shield plate held against said plastic film at the outer side thereof and extending completely across at least one transverse dimension of said space, and delivering loose insulation into said space behind said sheet of plastic film, and leaving said sheet of plastic film in place to provide a permanent vapor barrier at one side of said insulation.

2. Method according to claim 1, wherein said shield plate is formed of transparent sheet material whereby the completeness of filling of said space behind said plastic film with insulation may be visually inspected through said film and through said shield plate.

3. Method according to claim 2, wherein said transparent sheet material is stiffened by reinforcing elements to maintain said shield plate in a flat configuration.

4. Method according to claim 2, wherein said transparent sheet material comprises a plastic material.

5. Method according to claim 4, said space comprising the space between two studs of a building, a wall being disposed across said studs at the sides thereof opposite said plastic film.

6. Method for installing loose insulation in a space enclosed vertically therearound except at one side and enclosed at its bottom, comprising covering said one side of said space with a sheet of plastic film to support insulation in said space and to form a vapor barrier, said plastic film being bent outwardly and downwardly adjacent its upper edge and said insulation is delivered into said space over the edge of said bend, and delivering loose insulation into said space behind said sheet of plastic film, and leaving said sheet of plastic film in place to provide a permanent vapor barrier at one side of said insulation, said bent portion of said plastic film being affixed to cover the upper portion of said one side of said space after filling of said space with insulation has been completed to extend said vapor barrier formed thereby to the upper end of said space.

7. Method for installing loose insulation in a space enclosed vertically therearound except at one side and enclosed at its bottom, comprising covering said one side of said space with a sheet of plastic film to support insulation in said space and to form a vapor barrier, and delivering loose insulation into said space behind said sheet of plastic film, and leaving said sheet of plastic film in place to provide a permanent vapor barrier at one side of said insulation, temporarily supporting said film with a transparent plate placed over its outer side during said delivery of said insulation into said space, whereby said insulation in said space may be visually inspected therethrough.

8. Method according to claim 7, wherein said space is the space between studs of a wall and wherein a wall covers said studs at the sides thereof opposite said film, and including removing said shield plate and covering said film with a wall panel structure after filing of said space with insulation has been completed.

9. Method according to claim 8, wherein said film has an opening therethrough through which said insulation is delivered into said space.

10. Method according to claim 8, wherein said shield plate has an opening therethrough through which said insulation is delivered into said space.

* * * * *